US010156085B2

(12) United States Patent
Standley et al.

(10) Patent No.: US 10,156,085 B2
(45) Date of Patent: Dec. 18, 2018

(54) RESTRAINT RESISTANT HANDLE

(71) Applicant: Rockwood Manufacturing Company, New Haven, CT (US)

(72) Inventors: Brian Standley, New Haven, CT (US); Doug Thompson, New Haven, CT (US); Luis Bettencourt, New Haven, CT (US); Lee Griswold, New Haven, CT (US); Catelyn Herman, New Haven, CT (US)

(73) Assignee: Rockwood Manufacturing Company, New Haven, CT (US)

( * ) Notice: Subject to any disclaimer, the term of this patent is extended or adjusted under 35 U.S.C. 154(b) by 0 days.

(21) Appl. No.: 15/457,271

(22) Filed: Mar. 13, 2017

(65) Prior Publication Data

US 2017/0260772 A1 Sep. 14, 2017

Related U.S. Application Data

(60) Provisional application No. 62/306,794, filed on Mar. 11, 2016.

(51) Int. Cl.

| | |
|---|---|
| ***E05B 1/00*** | (2006.01) |
| ***B21D 28/10*** | (2006.01) |
| ***B21D 53/38*** | (2006.01) |

(52) U.S. Cl.

CPC ..... *E05B 1/0015* (2013.01); *B21D 28/10* (2013.01); *B21D 53/38* (2013.01); *E05B 1/003* (2013.01)

(58) Field of Classification Search

CPC ... Y10T 16/458; E05B 1/0015; E05B 1/0053; E05B 1/003; B21D 28/10; B21D 53/38; A47B 95/02; A47B 2095/027

See application file for complete search history.

(56) References Cited

U.S. PATENT DOCUMENTS 2,555,783 A * 6/1951 Bryson ..... E06B 37/285 16/402
3,121,907 A * 2/1964 Stebbins ..... E05B 1/0053 16/225

(Continued)

FOREIGN PATENT DOCUMENTS

CN 204098618 1/2015

OTHER PUBLICATIONS

1000 New Innovative Products in the IronmongeryDirect New Catalogue. PRweb.com Jun. 13, 2011. [May 4, 2017]. Retrieved from Internet: URL:,http://www.prweb.com/releases/Ironmongerydirect/antiligature/prweb8513066.htm>.

*Primary Examiner* — Chuck Y Mah
(74) *Attorney, Agent, or Firm* — DeLio, Peterson & Curcio, LLC; Peter W. Peterson

(57) ABSTRACT

A door handle pull securable to a surface of a door hinged on one edge thereof, for preventing the securing of lockable items thereto, the door handle pull. The door handle pull comprises a flat door handle grip extending from the door at an acute angle with respect to the door surface and in a direction away from the door surface, the door handle grip having a width tapering from a wider width adjacent the door to a narrower width near a distal end with an edge on the hinge side of the door extending at an acute angle to vertical. The tapered width of the grip and acute angle of the grip edge resists attachment of a locking device to the grip and urges a locking device downward off of the grips as the door is opened and the locking device is tightened.

12 Claims, 6 Drawing Sheets

(56) References Cited

U.S. PATENT DOCUMENTS

| | | | | |
|---|---|---|---|---|
| 5,403,047 | A | 4/1995 | Walls | |
| 6,293,598 | B1 | 9/2001 | Rusiana | |
| 6,382,750 | B1 * | 5/2002 | King | A47B 95/00 16/901 |
| D458,528 | S * | 6/2002 | Simon | D8/300 |
| D474,101 | S * | 5/2003 | Simon | D8/346 |
| D474,675 | S * | 5/2003 | Simon | D8/346 |
| D510,012 | S * | 9/2005 | Woods | D8/310 |
| D544,334 | S * | 6/2007 | Dismuke | D8/307 |
| 7,373,694 | B1 * | 5/2008 | Kopp | E05B 1/0015 16/412 |
| 8,584,494 | B2 | 11/2013 | Salvatore et al. | |
| 9,115,530 | B2 * | 8/2015 | Michael | E05F 11/54 |
| 2008/0142462 | A1 * | 6/2008 | Whyzel | A47K 17/022 211/123 |
| 2010/0013248 | A1 * | 1/2010 | Keller | E05B 1/0007 292/347 |
| 2010/0072762 | A1 * | 3/2010 | Marks | E05B 1/0007 292/336.3 |
| 2010/0126239 | A1 * | 5/2010 | Berger | E05B 13/005 70/92 |
| 2011/0120024 | A1 * | 5/2011 | Shilts | E05B 1/0007 49/506 |
| 2013/0019434 | A1 * | 1/2013 | Kopp | E04F 11/1802 16/110.1 |
| 2015/0211253 | A1 | 7/2015 | Shah et al. | |

* cited by examiner

RESTRAINT RESISTANT HANDLE

BACKGROUND OF THE INVENTION

1. Field of the Invention

The present invention relates to door pulls and door handles which are resistant to being locked or secured to another door handle or other object.

2. Description of Related Art

There are building spaces which are prone to being secured by an unauthorized person or group for inappropriate access restriction. These spaces are meant to be accessed by the public with the access being required for the public's safety. Door handles may generally be used by the unauthorized person or group to secure the door or doors in a closed position by fastening a device about the handle and either another corresponding handle or an item attached to a nearby wall, ceiling or floor. A door handle is needed in building areas prone to unauthorized personnel attempting to secure doors which are meant to be accessible.

SUMMARY OF THE INVENTION

Bearing in mind the problems and deficiencies of the prior art, it is therefore an object of the present invention to provide a door handle which is resistant to being locked or secured to another door handle or other object.

It is another object of the present invention to provide a method of using door handles which are resistant to being locked or secured to another door handle or other object.

A further object of the invention is to provide a method of making door handles which are resistant to being locked or secured to another door handle or other object.

It is yet another object of the present invention to provide a door handle which is resistant to being locked or secured to another door handle or other object by providing rotatability to the door handle.

Still other objects and advantages of the invention will in part be obvious and will in part be apparent from the specification.

The above and other objects, which will be apparent to those skilled in the art, are achieved in the present invention which is directed to a door handle pull securable to a surface of a door hinged on one edge thereof for preventing the securing of lockable items thereto. The door handle pull comprises a flat door handle grip extending from the door at an acute angle with respect to the door surface and in a direction away from the door surface. The door handle grip having a width tapering from a wider width adjacent the door to a narrower width near a distal end with an edge on the hinge side of the door extending at an acute angle to vertical. The tapered width of the grip and acute angle of the grip edge resists attachment of a locking device to the grip and urges a locking device downward off of the grips as the door is opened and the locking device is tightened. The door handle pull may include a door handle plate securable to the door surface, the door handle plate having at least one edge and including the flat door handle grip extending from the door handle plate edge at an acute angle. The door handle grip may be rotatable with respect to the door handle plate to increase the angle of the grip edge with respect to vertical and further prevents a locking device from being attached to the grip. The door handle pull may comprise a pair of the door handle pulls, each pull being secured to one of a pair of doors at adjacent edges thereof, the tapering angled edges of the door handle grips being on opposite sides of the door handle pulls to prevent a locking device from being attached between the pair of door handle grips. The door handle grip may extend from a door handle plate disposable on the door surface. The grip may be stamped from door handle plate. The lower end of the grip may be parallel to the door surface. The grip taper may be non-symmetrical.

Another aspect of the present invention is directed to a method of preventing the securing of a lockable item to a door having a hinge on one edge thereof. The method comprises providing a door handle pull having a flat door handle grip extending from the door at an acute angle with respect to the door surface and in a direction away from the door surface. The door handle grip has a width tapering from a wider width adjacent the door to a narrower width near a distal end with an edge on the hinge side of the door extending at an acute angle to vertical. The tapered width of the grip and acute angle of the grip edge resists attachment of a locking device to the grip and urges a locking device downward off of the grips as the door is opened and the locking device is tightened. The method includes mounting the door handle pull on the surface of the door adjacent a door edge opposite the hinged edge and placing a restraining device around the grip of the door handle pull. The tapered width of the grip causes the restraining device to fall below the grip distal end when the restraining device is released by the user or when the door is opened.

Another aspect of the present invention is directed to a door handle pull securable to a surface of a door hinged on one edge thereof for preventing the securing of lockable items thereto. The door handle pull comprises a door handle plate disposable on the door surface and a flat door handle grip extending from the door handle plate at an acute angle with respect to the door handle plate and in a direction away from the door handle plate. The door handle grip has a width tapering from a wider width at the door handle plate to a narrower width near the distal end with an edge on the hinge side of the door extending at an acute angle to vertical. The tapered width of the grip and acute angle of the grip edge resists attachment of a locking device to the grip and urges a locking device downward off of the grips as the door is opened and the locking device is tightened. The door handle grip may be rotatable with respect to the door handle plate to increase the angle of the grip edge with respect to vertical and further prevents a locking device from being attached to the grip. The door handle pull may comprise a pair of the door handle pulls, each pull being secured to one of a pair of doors at adjacent edges thereof, the tapering angled edges of the door handle grips being on opposite sides of the door handle pulls to prevent a locking device from being attached between the pair of door handle grips. The grip maybe stamped from door handle plate. The lower end of the grip may be parallel to the door handle plate.

Another aspect of the present invention is directed to a method of making a door handle grip for attaching to a surface of a door which prevents the securing of lockable items to the door handle grip. The method comprises providing an elongated flat door handle plate, forming an incision on the door handle plate, the incision forming a tongue in a central location in the door handle plate, the tongue remaining attached to the door handle plate along an upper portion of the tongue and urging the tongue outward from the door handle plate surface at an angle acute to the door handle plate surface. The method may include bending an end portion of the distal end of the tongue until the end portion is substantially parallel to the door handle plate. The incision may be formed with a laser. The tongue may have a width tapering from a wider width at the door handle plate to a narrower width near the distal end of the tongue. The incision may be formed by a stamping process. The forming of the tongue at an acute angle and bending of the end portion of the tongue may be performed during the stamping process.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 3:
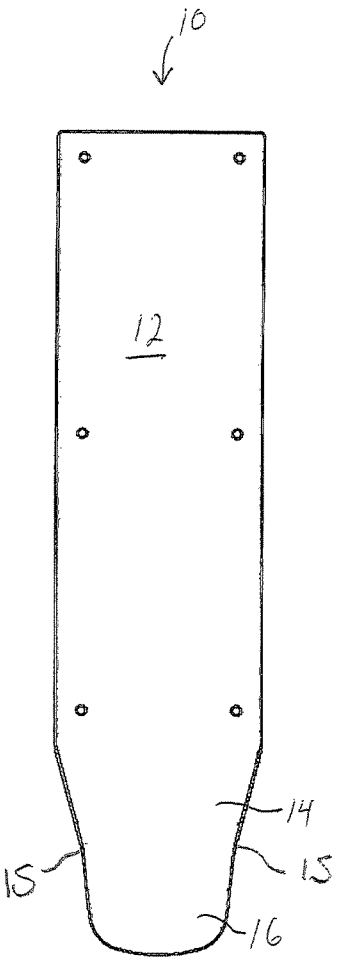
FIG. 3 is a front elevational view of the door handle shown in FIG. 1.
Figure 2:
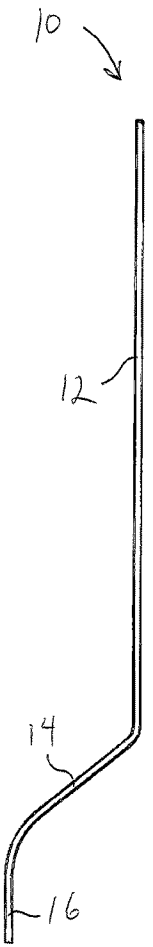
FIG. 2 is a side elevational view of the door handle shown in FIG. 1.
Figure 1:
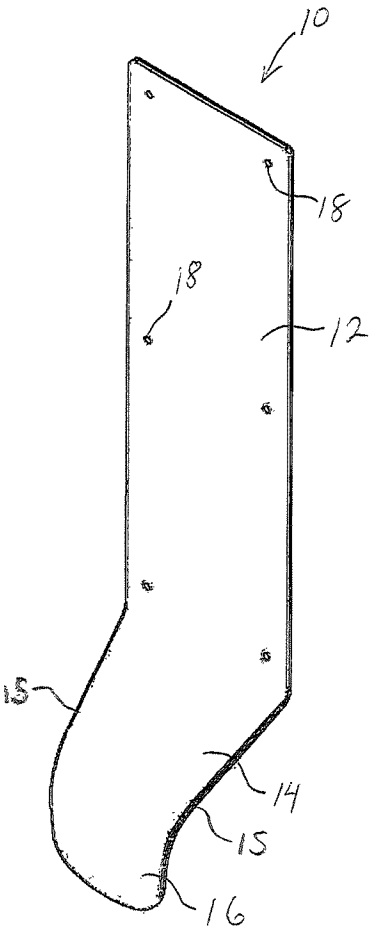
FIG. 1 is a perspective view of an embodiment of the door handle according to the present invention.
Figure 5:
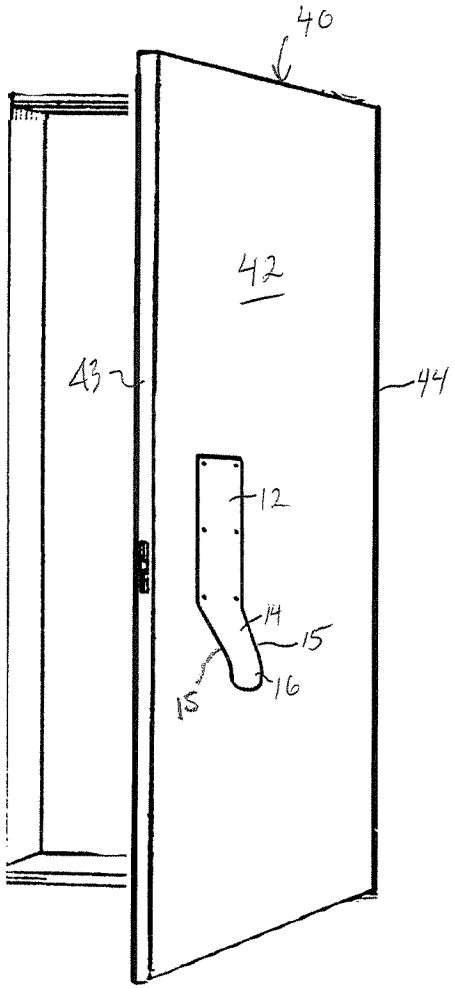
FIG. 5 is a perspective view of the door handle of FIG. 1 mounted on an open door.
Figure 4:
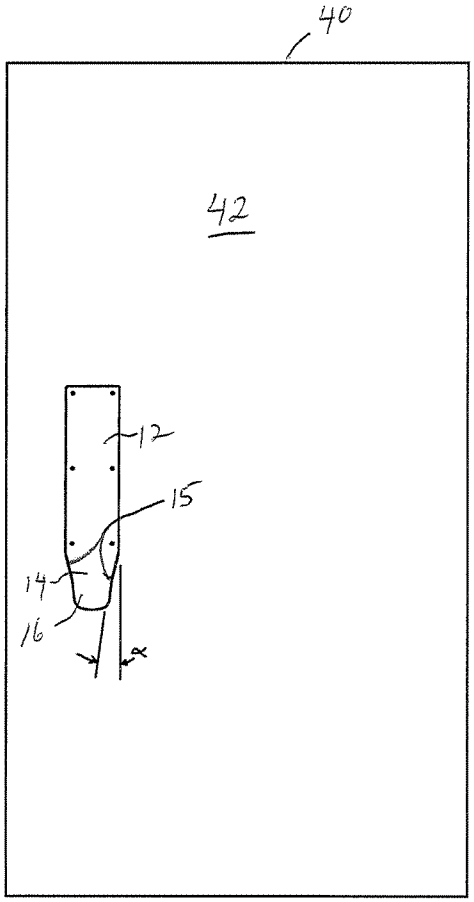
FIG. 4 is a front elevational view of the door handle of FIG. 1 mounted on a door.
Figure 9:
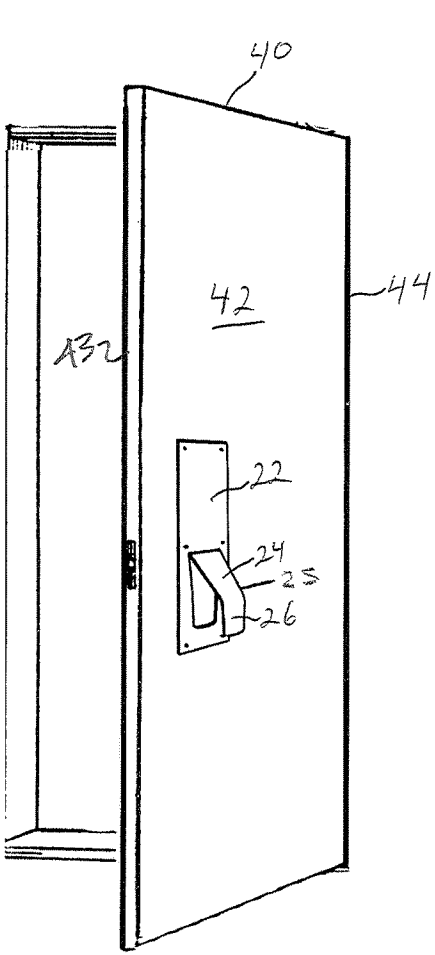
FIG. 9 is a front elevational view of the door handle of FIG. 6 mounted on an open door.
Figure 8:
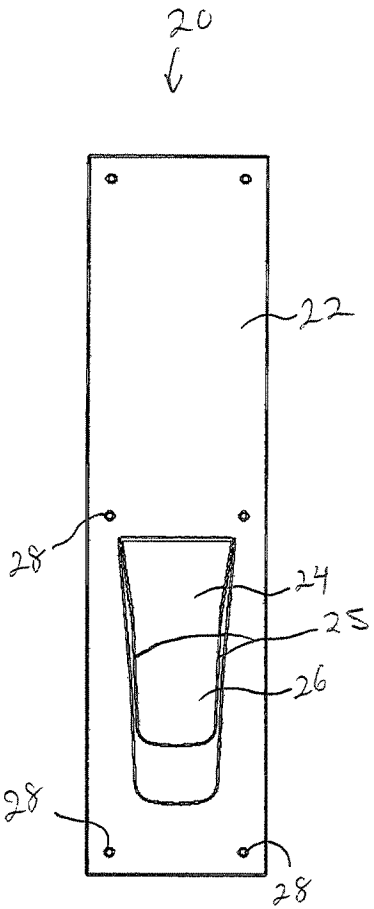
FIG. 8 is a front elevational view of the door handle shown in FIG. 6.
Figure 7:
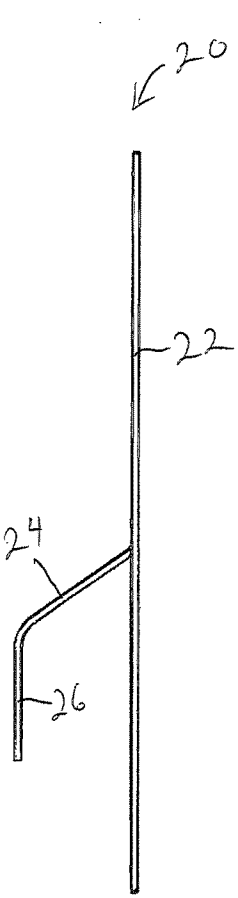
FIG. 7 is a side elevational view of the door handle shown in FIG. 6.
Figure 6:
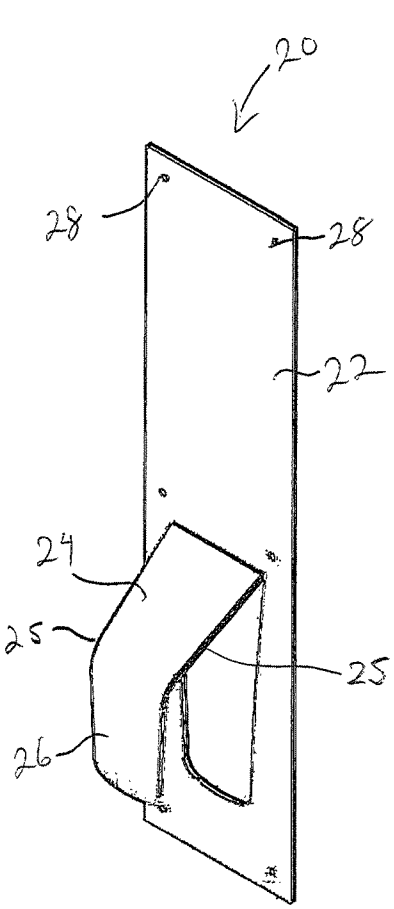
FIG. 6 is a perspective view of a second embodiment of the door handle according to the present invention.
Figure 13:
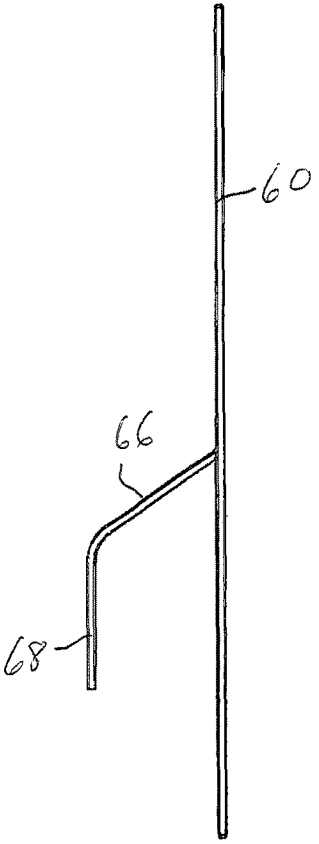
FIG. 13 is a side elevational view showing a third step in a method for making a door handle.
Figure 12:
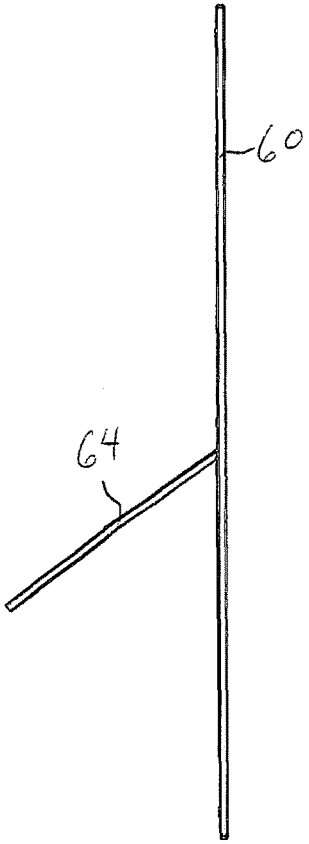
FIG. 12 is a side elevational view showing a second step in a method for making a door handle.
Figure 11:
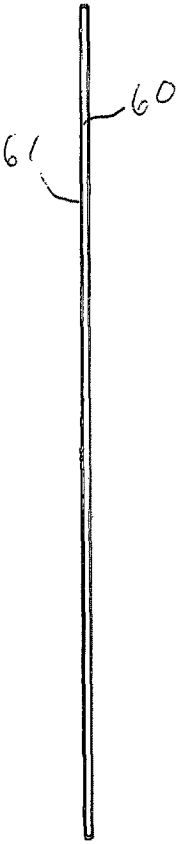
FIG. 11 is a side elevational view showing the step of FIG. 10.

In describing the preferred embodiment of the present invention, reference will be made herein to FIGS. 1-17 of the drawings in which like numerals refer to like features of the invention.

The handcuff and lock resistant door pull and handle of the present invention is described herein in two embodiments, one stationary and one with a moving pull component. The stationary embodiment may be used on most door applications except where a narrow door stile version is required, in which case the moveable embodiment may be used.

FIGS. 1-5 show a restraint resistant door handle pull 10 securable to a surface 42 of a door 40 hinged on one edge 44 thereof for preventing the securing of lockable items to the door handle pull 10. The door handle pull 10 is disposed adjacent the door edge 43 opposite the hinged edge 44 and includes a flat door handle plate 12 attachable substantially flush to the door surface 42 and at the lower end an angled or upper grip portion 14 extending from the door surface 42 at an acute angle with respect to the plane of door surface 42 and in a direction away from the door surface 42. The door handle pull 10 may include a bottom distal grip portion 16 extending from the upper grip portion 14 and may be substantially parallel to the door surface 42. The door handle grip 14, 16 has a width tapering from a wider width at the door handle plate 12 to a narrower width at the distal end portion 16. The grip portion of door handle pull 10 includes an edge 15 on the hinge side of the door 40 extending at an acute angle $\alpha$ to vertical. This angle $\alpha$ may be the same the entire length of the grip 14, or may vary. The tapered width of the grip 14, 16 and acute angle $\alpha$ (FIG. 4) of the grip edge 15 resists attachment of a locking device to the grip and urges a locking device downward off of the grips as the door is opened and the locking device is tightened. The door handle pull 10 includes a plurality of fastener openings 18 for fastening the door handle pull 10 to the surface 42 of the door 40. Alternately, the openings 18 may be replaced with tack welds or rivets if the door is constructed of metal.

Another embodiment of the restraint resistant handle is shown in FIGS. 6-9. The door handle pull 20 includes a door handle plate 22 securable to the door surface 42. The door handle pull 20 includes an angled or upper grip portion 24 extending from the door surface 42 at an acute angle with respect to the door surface 42 and in a direction away from the door surface 42. The door handle pull 20 may include a lower distal grip portion 26 extending from the upper grip portion 24 and may be substantially parallel to the door surface 42. The grip portions 24, 26 of door handle plate 22 has at least one edge 25 extending at an acute angle $\alpha$ to vertical and the flat door handle grip extends from the plane of the door handle plate 22 at an acute angle, in a manner similar to the embodiment of FIGS. 1-5. The door handle pull 20 includes a plurality of fastener openings 28 for fastening the door handle pull 20 to the surface 42 of the door 40. Alternately, the openings 28 may be replaced with tack welds or rivets if the door is constructed of metal. The upper grip portion 24 and distal grip portion 26 is formed from a portion of the door handle plate 22 during the manufacturing process.

Figure 10:
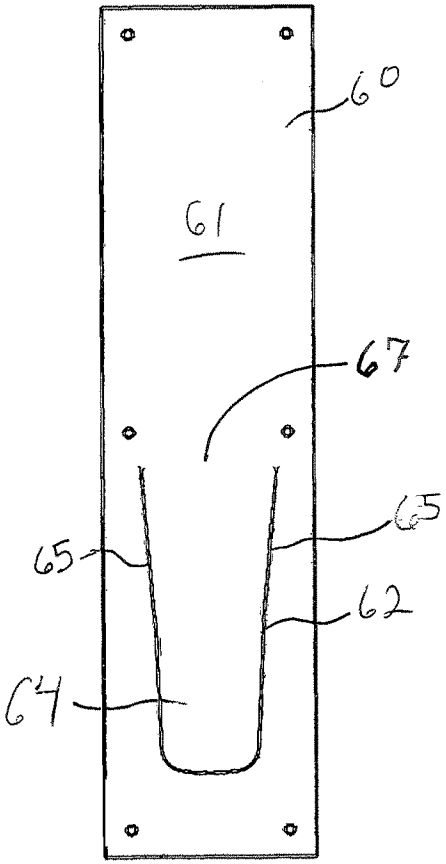
FIG. 10 is a front elevational view showing a first step in a method for making a door handle.

FIGS. 10-13 show a method of making a door handle grip for attaching to a surface of a door which prevents the securing of lockable items to the door handle grip. The method includes providing an elongated flat door handle plate 60 and forming an incision 62 on the door handle plate 60 as shown in FIG. 10, at which point the shape of the door handle plate 60 remains the same as shown in the side view of the door handle plate 60 in FIG. 10. The incision 62 forms a tongue 64 in a central location of the door handle plate 60, the tongue 64 remaining attached to the door handle plate along an upper portion 67 of the tongue 64. The method includes urging the tongue 64 outward from the door handle plate surface 61 at an angle acute to the door handle plate surface 61 and bending an end or distal portion 68 of the tongue 64 until the end portion 68 is substantially parallel to the door handle plate and the upper grip portion 66 is maintained at an angle acute to the plane of door handle plate surface 61. The incision 62 may be made by a laser, sharp tool or any instrument capable of cutting a metal plate. Alternately, a stamping tool or punch may concurrently make the incision while forming the upper grip portion and distal grip portion from the door handle plate 60. The grip may have edges 65 of tongue 64 that have angle α with respect to vertical, as with the previous embodiments.

Figure 15:
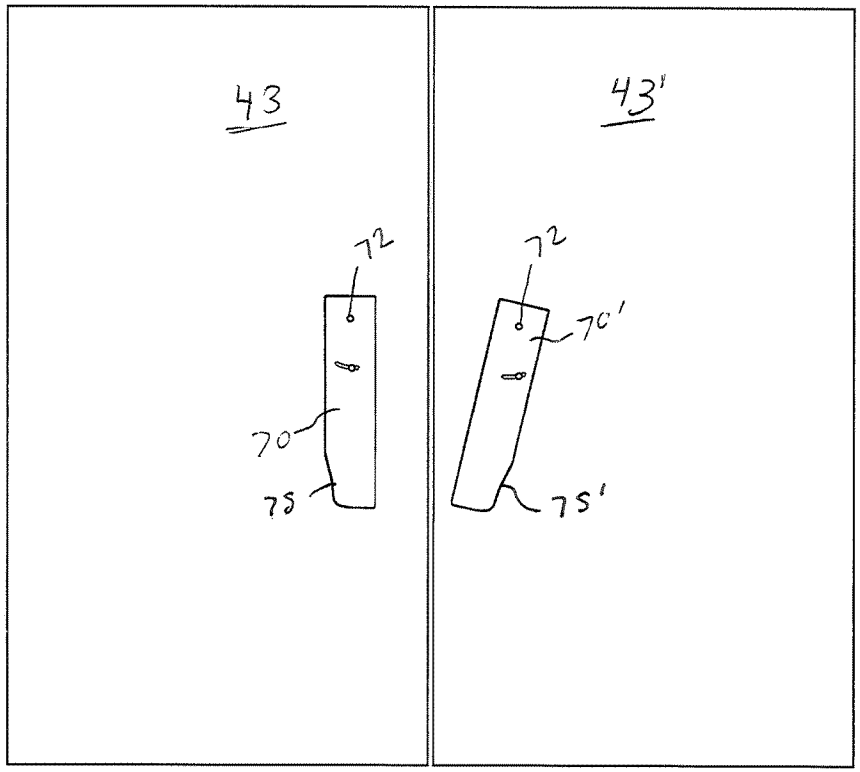
FIG. 15 is a front elevational view of a pair of pivotal door handles mounted on a set of double doors.
Figure 14:
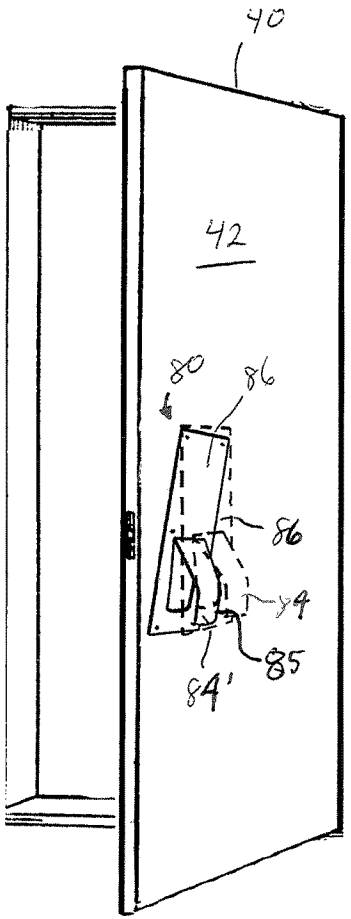
FIG. 14 is a front elevational view of a pivotal door handle in a first and second position according to the present invention.
Figure 16:
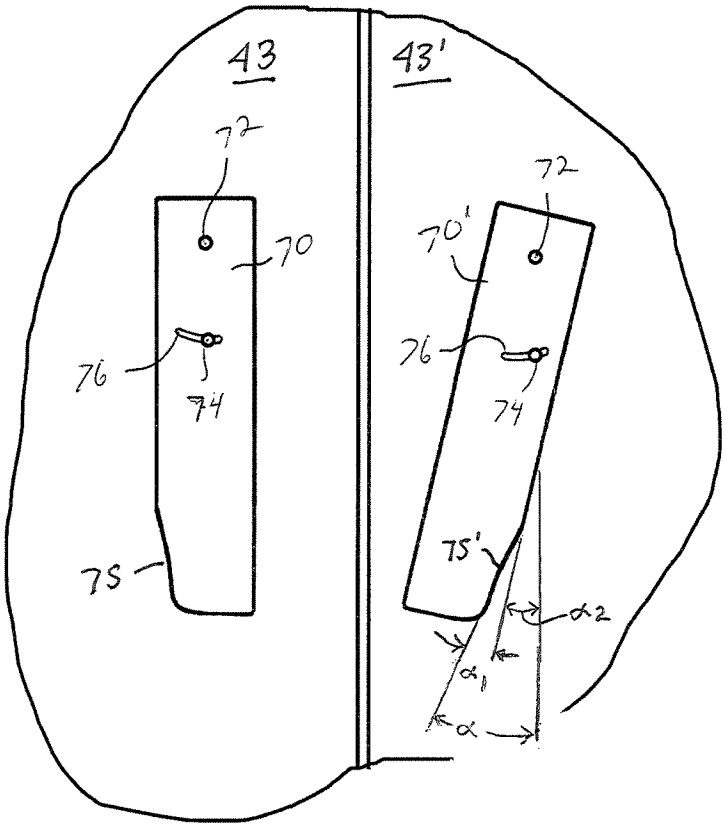
FIG. 16 is a close-up view of the pivotal door handles shown in FIG. 16.

As shown in FIGS. 14-16, the door handle pull 70, 70', 80 may be rotatable with respect to the door to increase the angle of the grip edge with respect to vertical and further prevents a locking device from being attached to the grip. FIG. 14 shows a door 40 having on the door surface 42 an attached pull 80 with handle grip 84 extending from the door handle plate 86 in a first non-rotated position and the door handle grip 84' extending from the door handle plate 86 in a rotated position. Door pull 84' in the rotated position results in an increased angle of hinge-side tapered edge 85 with respect to vertical, which increases the ability of the door pull to shed a restraint that might be attached to or wrapped around it.

FIGS. 15 and 16 show a set of double doors 43, 43' having a door handle pull 70 on the left side door 43 and a rotatable door handle pull 70' in the rotated position on the right side door 43'. The door handle pulls 70, 70' include a first fastener 72 rotatably securing the door handle pulls 70, 70' and a second fastener 74 slidingly engaged within a curved slot 76 on each of the door handle pulls 70, 70'. The curved slot 76 allows the door handle pulls 70, 70' to rotate about the first fastener 72 in a direction away from the door hinge edge so that a locking device cannot be secured to the door handle pull 70, 70'. As with the door pull of FIG. 14, the pivoting of handle pull 70' on door 43' as shown in FIG. 16 results in an increase of the angle α of tapered edge 75' with respect to vertical, because of the addition of rotation angle α2 to the original angle α1, which increases the resistance to attachment of a locking device.

Figure 17:
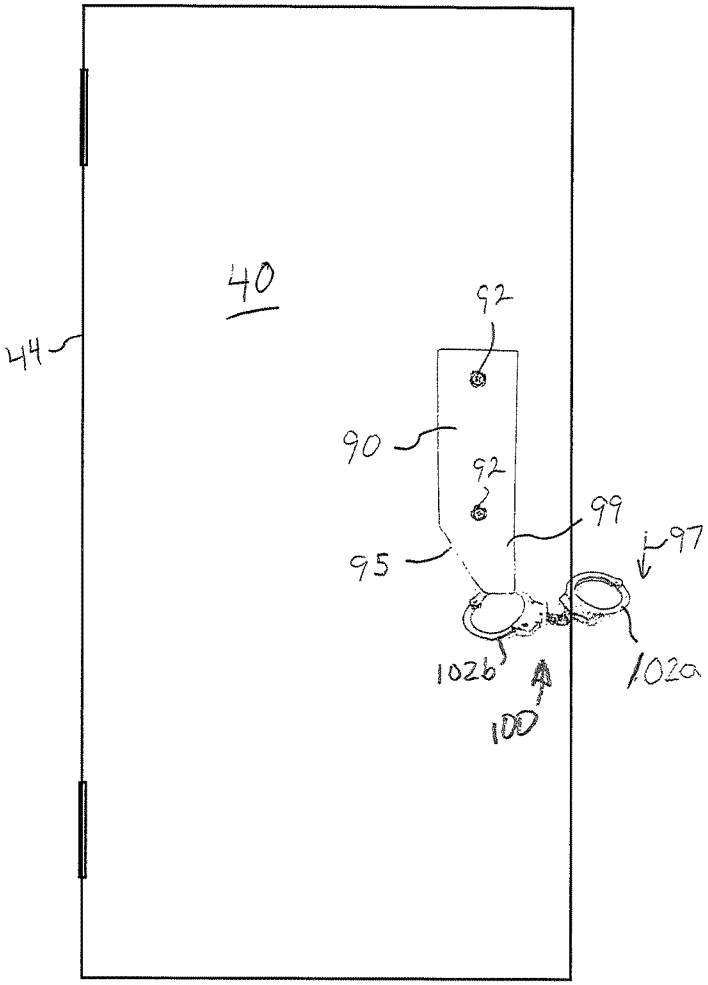
FIG. 17 is a front elevational view of a door handle unable to hold a set of handcuffs.

FIG. 17 shows another embodiment of a door handle pull 90 including a grip 99 having an edge 95 toward the hinged edge 44 of a door 40, with the edge 95 at an acute angle to vertical. A pair of handcuffs 100 is shown sliding off in a downward direction 97, because cuff 102*b* of the handcuffs 100 is unable to secure about the door handle grip 99, whether or not the other cuff 102*a* is secured to a fixed point or to another tapered door grip of an adjacent door (as in FIGS. 15 and 16).

A method of preventing the securing of a lockable item to a door having a hinge on one edge thereof comprises providing the door handle pull as described above, mounting the door handle pull on the surface of the door adjacent a door edge opposite the hinged edge and placing a restraining device around the grip of the door handle pull, wherein the tapered width of the grip causes the restraining device to fall below the grip distal end when the restraining device is released by the user or when the door is opened.

In an example of the door handle pull, the material may ⅛" thick stainless steel. The pulls may be made out at least 0.050" thick 17-4PH stainless steel to better resist bending in the field. The overall length may be approx. 10¼" by 3½" wide, about 8" of the pull comprising a door handle plate portion mounted flush against the door. The handle grip portion of the pull then angles away from the door at approximately a 50 degree angle to achieve approximately a 1¾" door clearance distance. The handle grip portion may extend downward parallel to the door for another 1" length. The handle grip portion has a tapered width so that on the hinge side edge there may be a relieving angle at approximately 35 degrees from vertical that runs from the flush mounted surface of the handle plate portion to the lower end of the grip handle. This angle is what achieves the resistance to and prevents the pair of handles from being locked or handcuffed together to prevent free egress. By utilizing gravity and the relief angle, anything that is wrapped around the two pulls will not have a flat surface or pinch point to secure to, and the increasing relief angle causes a natural loosening of the locking device when the door is opened, causing the locking device to fall to the ground.

The rotatable and moveable embodiment is the same as above but may be used for narrow stile or other applications. Because of the decreased handle width there may only be a 12 degree angle that can be put on the grip portion of the pull. However, by adding a moving pull component of 12 degrees, i.e., permitting the handle grip portion to rotate around a pivot point on the handle plate portion, a combined grip edge angle of about 24 degrees per side can be achieved, which is adequate for the natural loosening described above. The degree of pivoting may be any that results in an angle of edge up to 90 degrees to vertical.

The pull of the present invention designed with safety in mind including the criteria that two pulls side by side cannot easily be latched together so that the door is prohibited from being opened, preventing egress. The door pull of the present invention may be retrofitted in place to original pulls to cover previous holes in the door from prior hardware. Additionally the door pull may be manufactured with identical tapers on both pull side edges so they are not handed in the event that an installer installed them backwards that they might otherwise be banded together.

Both embodiments utilize tapered angles that repel ligature from securing door shut and preventing egress. With the combination of the angles and gravity the ligature should easily fall to the ground.

Retrofit Design—For the retrofit design, the handle piece may be cut from a location somewhere inside the push plate and then the handle piece is formed. There is stainless steel plate surrounding all four sides of the handle grip piece. The stainless steel plate surrounding the handle gives it the ability to cover existing openings or flaws on an existing door. The retrofit design has the ability to make the handle at a location that is preferable to the customer, top of the plate, center, or bottom of the plate. The plate handle creates an opportunity of adding a cylinder location. This embodiment allows adjustment of the handle location, allows for various cylinder options and may be non-handed.

New Construction Design—For the new construction design, the handle piece may be formed at the bottom of the plate. Stainless steel plate is only on the top of the handle. This design is aesthetically pleasing and the above plate area gives the opportunity of adding a hole location for a cylinder. This embodiment allows for various cylinder options and may also be non-handed.

The handle portion of the new construction design may be larger than the handle portion of the retrofit design. Both embodiments have handles that are easy to grasp.

The objects of the invention as delineated at the beginning of the application have each been met including providing a door handle which is resistant to being locked or secured to another door handle or other object, providing a method of using door handles which are resistant to being locked or secured to another door handle or other object and providing a method of making door handles which are resistant to being locked or secured to another door handle or other object. The object of providing a door handle which is resistant to being locked or secured to another door handle or other object by providing rotatability to the door handle has also been met.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door handle pull securable to a surface of a door hinged on one edge thereof, for preventing the securing of lockable items thereto, the door handle pull comprising:

at least one door having a surface, and a hinge side;

a door handle plate for securing the door handle pull to the door surface opposite the hinge side;

a door handle grip extending from the door handle plate at an acute angle with respect to the door surface and in a direction away from the door surface, the door handle grip having a width tapering downward from a wider width adjacent the door to a narrower width near a distal end of the door handle grip with an edge on the hinge side of the door extending at a constant acute angle to vertical;

whereby the tapered width of the grip and acute angle of the grip edge resists attachment of a locking device to the grip and urges a locking device downward off of the grips as the door is opened and the locking device is tightened.

2. The door handle pull of claim 1 wherein the door handle grip is rotatable with respect to the door to increase the angle of the grip edge with respect to vertical and further prevent a locking device from being attached to the grip.

3. The door handle pull of claim 1 comprising a pair of the door handle pulls, each pull being secured to one of a pair of doors at adjacent edges thereof, the tapering angled edges of the door handle grips being on opposite sides of the door handle pulls to prevent a locking device from being attached between the pair of door handle grips.

4. The door handle pull of claim 1 wherein the grip extends from a portion of the door handle plate and the grip is stamped from the door handle plate.

5. The door handle pull of claim 1 wherein the grip is stamped from the door handle plate.

6. The door handle pull of claim 1 wherein the lower end of the grip is parallel to the door surface.

7. The door handle pull of claim 1 wherein the grip taper is non-symmetrical.

8. A door handle pull securable to a surface of a door hinged on one edge thereof for preventing the securing of lockable items thereto, the door handle pull comprising:

at least one door having a surface, and a hinge side;

a door handle plate disposable on the door surface;

a flat door handle grip extending from the door handle plate at an acute angle with respect to the door handle plate and in a direction away from the door handle plate, the door handle grip having a width tapering downward from a wider width at the door handle plate to a narrower width near the distal end of the door handle grip with an edge on the hinge side of the door extending at a constant acute angle to vertical;

whereby the tapered width of the grip and acute angle of the grip edge resists attachment of a locking device to the grip and urges a locking device downward off of the grips as the door is opened and the locking device is tightened.

9. The door handle pull of claim 8 wherein the door handle grip is rotatable with respect to the door to increase the angle of the grip edge with respect to vertical and further prevent a locking device from being attached to the grip.

10. The door handle pull of claim 8 comprising a pair of the door handle pulls, each pull being secured to one of a pair of doors at adjacent edges thereof, the tapering angled edges of the door handle grips being on opposite sides of the door handle pulls to prevent a locking device from being attached between the pair of door handle grips.

11. The door handle pull of claim 8 wherein the grip is stamped from door handle plate.

12. The door handle pull of claim 8 wherein the lower end of the grip is parallel to the door handle plate.

* * * * *